United States Patent [19]

DiRusso, Jr. et al.

[11] Patent Number: 4,869,769

[45] Date of Patent: Sep. 26, 1989

[54] METHOD AND APPARATUS FOR FORMING PULL-TABS ON A SEALING TAPE COURSE LENGTH APPLIED TO A CARTON

[75] Inventors: Anthony DiRusso, Jr., No. Bellmore; Joseph S. Lerner; David Krukas, both of Kings Park, all of N.Y.

[73] Assignee: The Loveshaw Corporation, Ronkonkoma, N.Y.

[21] Appl. No.: 55,164

[22] Filed: May 28, 1987

[51] Int. Cl.[4] ..... B31B 1/72; B31B 7/60

[52] U.S. Cl. ..... 156/269; 156/468; 156/475; 156/486; 156/521; 156/522

[58] Field of Search ..... 156/468, 486, 475, 522, 156/521, 269

[56] References Cited

U.S. PATENT DOCUMENTS 2,754,023 7/1956 Sheridan ..... 156/522
3,901,757 8/1975 Eglinton ..... 156/522 X
4,039,367 8/1977 Warshaw et al. ..... 156/486
4,227,955 10/1980 Woods et al. ..... 156/522 X

OTHER PUBLICATIONS

The Bemis Company, Sales Pamphlet, Minneapolis, MN.

*Primary Examiner*—Michael W. Ball
*Assistant Examiner*—Jeff H. Aftergut
*Attorney, Agent, or Firm*—George J. Brandt, Jr.

[57] ABSTRACT

Pull tabs are applied to the two ends of the sealing courses of pressure sensitive tape applied to rectangular shipping cartons. A masking material is applied to the pressure sensitive tape during the taping operation so that the masking material will be adhered to a part of the sealing tape as a pull tab means which is applied to the rear wall of the carton being sealed and a part will be left on the tape stock to provide a pull tab means on the front wall of the carton to be next taped from the tape stock. An apparatus for forming these pull tab means also is provided.

25 Claims, 7 Drawing Sheets

10
12
14
16
18
20
21
22
23
24
24-1
24-2
26
28
30
32
34
L

METHOD AND APPARATUS FOR FORMING PULL-TABS ON A SEALING TAPE COURSE LENGTH APPLIED TO A CARTON

BACKGROUND OF THE INVENTION

The present invention relates to tape sealing a carton with a tape length course extending between a first location on the carton e,g., a front end and a second location, e.g., a rear end, and refers more particularly to forming a readily, digitally manipulated pull tab in the tape at one or both locations on the carton and with which the applied tape length can be stripped off the carton with pulling force applied thereto by means of the pull tab.

It is common practice to tape seal rectangular shipping cases or cartons with a continuous length of sealing tape, such as a pressure sensitive type, the tape being applied first at the front wall of the carton, onto and along either or both the bottom or top wall if upper and lower sealing courses are used, and then onto the rear wall, the tape courses along the top and bottom walls overlapping and sealing infolded closure flaps in place on the carton. The tape applied at the front and rear walls provides an anchorage length to securely hold the tape lay down at the top and bottom walls so that, e.g., any imposed loading of carton contents on the bottom wall cannot breach the tape seal along that surface or the top flaps cannot readily accidentally become opened. The anchorage lengths of tape applied to the front and rear walls of the carton will preferably be at least about 2 inches although longer lengths can be used as can shorter ones where carton sizes and loadings are of reduced magnitude. Most usually though, these anchorage lengths will be at least 2 inches.

As the tape in a given sealing course is being applied to the carton, it will be pressed firmly against the carton surfaces to provide good and uniform adhesion of the adhesive face of the tape to such surfaces including at the initial and terminal points of the tape course. Generally then it will not be possible for a person who wishes to open the carton to remove contents, to simply peel the tape course from the carton starting at one of the tape course ends, since the degree of tape adhesion is high and this is difficult to overcome with finger effected peeling force. Commonly a knife or similar sharp instrument will be employed by the person to slit the tape. This procedure can result in damage to products within the carton.

The use of a pull tab as an initiator for tear stripping cellophane wrappings on products of various descriptions is well known. The tearable strip on these wrappings is of course, not adhered to the product and the tear action is easily achieved. A device and manner for forming a pull tab on a carton sealing tape length at an end of the tape length is known. Such device, made by the Bemis Company of Minneapolis, Minn., folds back a terminal length of the adhesive face pressure sensitive against itself so the fold back becomes adhered leaving non-adhesive opposite faces at the fold back so that this fold back becomes a non-adhered tape pull tab on the carton. This device and manner of forming a pull tab has a number of disadvantages, viz., a. The fold back of the tape itself is wasteful of tape.
b. A pull tab is formed only at one end of the tape course—which fact would render the pull tab useless for tape stripping purposes if a large or heavy carton had the pull tab end disposed in an inaccessible disposition, as for example, abutting the end of another carton.
c. The pull tab because it is formed solely of pressure sensitive tape is somewhat stiffened and has a very smooth surface at both sides so it does not tend to sit close to the carton wall—this condition could allow for self-peeling of the associated tape anchorage run due to transportation jostling of the carton and especially where the carton is in close shipping contact with other cartons.
d. The pull tab uses a printed indicia denotive of its function. Since many of the pressure sensitive tapes are semi-transparent and very shiny, this indicia is hard to see.

It is therefore desirable that an improved method and apparatus be provided for forming sealing tape pull tabs on taped cartons and which method and apparatus do not have the undesirable shortcomings noted above.

SUMMARY OF THE INVENTION

An object of the present invention is to provide method and apparatus for forming pull tabs on taped cartons which can be applied at the beginning or the end thereof or at both places on the applied tape sealing course.

Another object is to provide a pull tab which lies up closely against an adjacent carton wall where it is situated inasmuch as narrow adhesion bands of tape adjoin the pull tab and serve to hold the pull tab in that positioning to prevent accidental peeling of the tape anchorage length at that carton wall.

A further object is to provide a pull tab which can be formed in a manner as lessens wastage of sealing tape.

In accordance with the present invention, pull tab forming apparatus and method for the objects and purposes aforesaid can be embodied in a carton sealing machine of the general type described in commonly owned U.S. Pat. No. 4,028,865 as well as others. The carton sealing machine of that patent tapes forwardly travelling cartons with tape courses either upper or lower ones, or both, initiated at a first location in the front wall, passing onto a top or bottom wall and then into the carton rear wall for termination at a second location in the carton, and for such purpose incorporates tape applying means in respective upper and lower taping cartridges. The taping cartridges each are fitted with a pair of pivoted, tandemly operating taping arms having a normally, spring bias extended position wherein they extend into the carton travel course. The traveling carton advances into contact with a tape feed presented by a roller carried on a first arm of the pair which applies and presses the tape to the carton front end. As the carton advances after this contact, it moves the arms in a retraction direction and at the same time draws a runout length of tape from a continuous stock thereof carried on a cartridge bracket and which runout length is applied to the carton. A cutter carried in the cartridge intermediate the paired taping arms is normally biased in a cutting direction, but the carton travel during taping engages the cutter to move it to a retracted or carton-held position until the carton advances beyond the cutter when it is released to move in a cutting direction to sever the runout length from the tape stock at a runout length locus that will correspond to the termination of the sealing tape course on the carton rear wall. Following this cutting operation, the continued advance of the carton along its travel course will bring it beyond the retracted arms to allow these retracted taping arms to move to extended positions during which movement the second arm of the pair will apply and press tape onto the carton rear wall.

The present invention provides that a mask be applied to the pressure sensitive sealing tape to mask adhesion of a segment of the adhesive face thereof at one or both of the ends of the tape course so that the mask together with the masked tape segment define a readily, digitally gripped and manipulated pull tab with which the length of tape applied to the carton can be stripped or removed therefrom with pulling force applied to the pull tab.

The apparatus or means by which this is accomplished is incorporated in the taping cartridge. A bracket fixed to the cartridge carries a stock, i.e., a roll of masking material. Disposed adjacent the masking material roll is an arm member pivoted at one end to the bracket while at the other end a presser member is rotatably mounted to the arm member.

The arm member defines, inter alia, an off-feed path for the masking material which leads to the presser member where an initial end of the masking material is held positioned by the presser member in proximity to the sealing tape runout length course. An air cylinder unit or similar motive device is connected to the arm member and is employed to move the arm member between first and second positions thereof. When the arm member is moved from first to second position, the presser member will move the masking material initial end against the sealing the adhesive face at a point thereon relative to and proximate the locus thereof which will cause the masking material to adhere to the sealing tape and also cause the masking material to off-feed until a certain length thereof has off-fed from its stock at which point said certain length will be cut from the masking material stock. This cutting will be accomplished by moving the arm member from second to first positions during which movement the masking material held by the presser member will be pulled across a fixed cutter. The severed certain length of masking material is carried forward adhered to the tape runout length being so positioned thereon that when the runout length is removed from its stock, masking material will be adhered along at least one of a length part of that tape running downstream of the runout length locus to serve as a mask blocking adhesion to the carton of a segment of the tape applied to the second location (rear wall) on the carton being taped, and a length part running upstream of said locus to serve as a mask blocking adhesion to the carton of a segment of the tape to be applied to the first location (front wall) on a carton to be next taped with a tape runout length from the sealing tape stock. In a preferred manner of operation of the invention, the certain length of masking material will be adhered for a distance on each side of the runout length locus so that when the runout length is severed from the tap stock, the certain length of masking material is divided into a part that is carried onto the carton being taped to provide a pull tab on its rear wall and a part remains on the lead tip end of the sealing tape stock to provide a pull tab on the front wall of the carton which will be next taped in the machine.

The masking material can be provided in a width thereof which in one form thereof is narrower than the width of the sealing tape. This will allow that an unmasked area remains on the sealing tape adjacent the masking material at the carton tape course initial and terminal ends, the ummasked area serving to hold the associated pull tab snubbed up closely at the carton end wall surface to inhibit accidental or post taping carton handling created peel-off of the tape course anchorage lengths. The pull tab will of course be readily accessible for pull away from the carton end wall and grasping with the fingers to effect tape course stripping for opening the carton. In another embodiment, the masking material width can be of a width which is only a minor fraction of the tape width and it can be applied to the tape at one side adjacent a tape margin so that a minor lateral expanse only of the tape at a terminal end thereof remains unadhered but at the same time an effective and easily accessed and gripped pull tab exists at such location on the tape course. The masking material need not be narrower than the tape. It could for a given circumstance of use be of the same or greater width than the tape.

The masking material can be any one of a wide range of materials inclusive of paper, metallic foil, thermoplastic film or the like. Pressure sensitive tape while less economical to use, also could be used in which case the sealing tape and masking material stock runs in the machine would be oriented in adhesive face-to-face dispositions thereof.

The length of the masking material applied to the runout length of sealing tape will be controlled by the movement of the arm member between first and second positions thereof and then return to the first normally idle position. This movement can be controlled with devices which detect, i.e., are operated by carton presence at predetermined locations along its travel course, i.e., operation can be carried out by the passage of the carton rear end beyond a particular device. Thus a first switch disposed in the carton travel course can be actuated by passby of the carton rear end and this actuation employed to admit air under pressure to the air cylinder unit or other motive means to move the arm member for first (idle) to second (mask material pressing) positions. A second downstream located switch can then be actuated by carton passby to dump air from the cylinder unit so that a spring bias force can return the arm member from second to first position with accompanying cutting of the masking material certain length. By mounting these two switches to be relatively, longitudinally adjustably positionable, the certain length of the masking material correspondingly can be varied.

By unitarily positioning the two switches at a specific relative distance to the sealing tape cutter when it is in carton held position, the placement of the masking material certain length relative to the tape runout length locus can be varied so that it can be disposed entirely at one or the other side of the locus or it can bridge the locus in equal or any number of ratios of unequal lengths.

The invention accordingly comprises the features of construction, combination of elements, arrangements of parts and taping steps practiced with the apparatus and method for applying pull tabs to tape course lengths which will be exemplified in the construction and method hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings, in which.

Throughout the following description, like reference numerals are used to denote like parts in the drawings.

DESCRIPTION OF THE PREFERRED EMBODIMENT

Figures 1, 2, 3, 4:
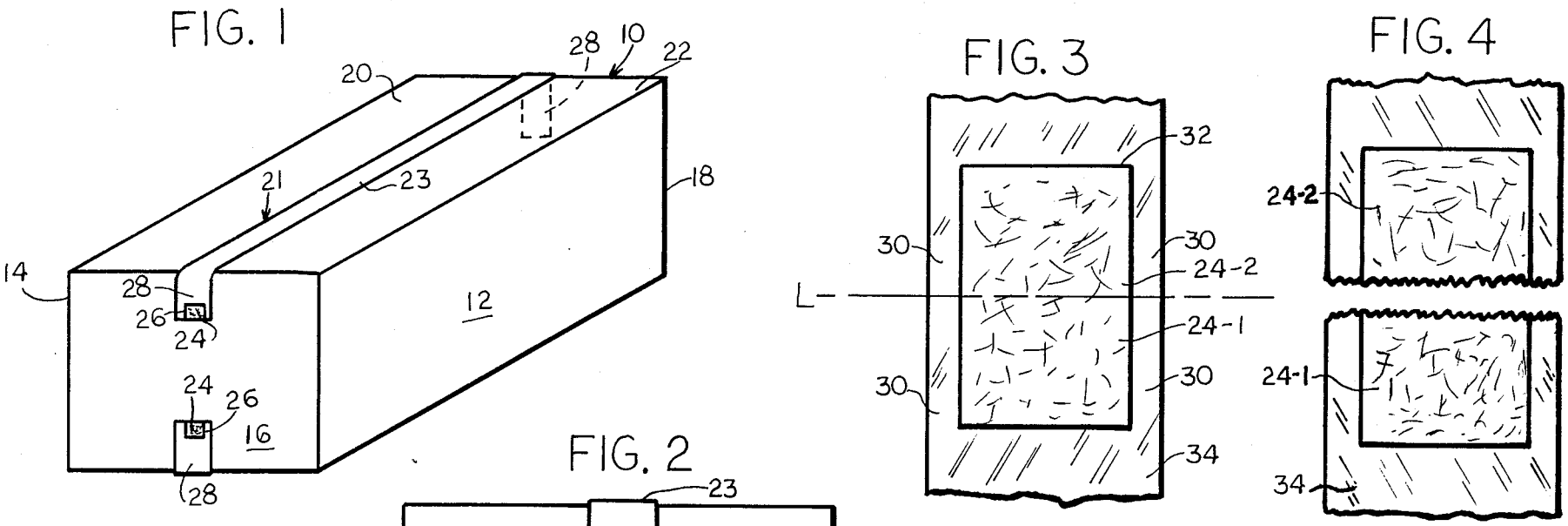
FIG. 1 is a fragmentary perspective view of a tape sealed carton which has been provided at the front end or wall thereof with pull tabs on the initial part of the tape courses in accordance with the principles of the present invention.
FIG. 2 is an elevational view on enlarged scale of the rear end of the taped carton shown in FIG. 1 illustrating how pull tabs are formed on the tape courses at that location.
FIG. 3 shows diagrammatically a portion of the pressure sensitive sealing tape drawn out from the stock thereof during taping and to the adhesive face of which has been adhered a certain length of masking material, the lay down of the masking material being such that substantially equal parts thereof are disposed on respective length runs of the sealing tape which extend upstream and downstream of the runout length locus.
FIG. 4 is a view similar to FIG. 3 but showing the masked sealing tape after the runout length has been severed at the locus thereof from the tape stock.

FIG. 1 shows a rectangular shipping case or carton 10 of conventional construction, i.e., it has side walls 12, 14, a front end wall 16, a rear end wall 18 and top and bottom walls, the last-mentioned walls commonly being formed by inturned closure flaps as, for example, the closure flaps 20, 22 which define the top wall. Common practice is to seal the carton with separate upper and lower continuous tape seal courses initiated at a first location as a front wall 16, passing onto the top or bottom wall and then onto the rear wall 18. The tape seal course across the top and bottom wall will overlap marginal portions of the abutting or closely edge confronting flaps defining the top or bottom walls. The runs of the sealing tape course on the front and rear walls serve as anchorage tape lengths to anchor the flaps against any flap outfolding movements as might be caused by carton contents loading or carton handling events incident shipping operations.

The present invention provides pull-tabs in the tape seal courses of the carton 10 as will be described in detail below. It will be understood however, that while the first and/or second location on the carton at which pull tabs will be formed most commonly will be at the front and rear end walls of the carton, the pull tab could be applied at any terminal end of a tape course wherever situated. Thus in a given circumstance a tape course might extend along only the top or a portion of the top of a carton. Use of and application of pull tabs to that tape course is contemplate by the present invention as well as in the L-clip tape courses disclosed in U.S. Pat. No. 4,640,731.

Referring again to FIG. 1, carton tape course 21 has a first location initiation on carton front wall 16, the major length part 23 running across the carton top wall and a second or termination location on carton rear wall 18. Pull tabs 24 can be applied at either one but preferably at both locations. The pull tab 24 will be defined by a masked segment of the pressure-sensitive tape adhesive face at the ends of the tape courses and the underlying mask 26 which constitutes the blocking means intervening the tape adhesive face segment and adjacent surface of the carton which segment otherwise and in the conventional taping practice would be adhered to the carton.

It will be noted and with reference to FIG. 2 additionally, that the anchoring length of tape as at 28 is present on each end wall of the carton, such anchor length being at least 2 inches and that there is the further length thereto that functions as the pull tab. It is advantageous but not essential that the width of the mask be narrower than the width of the sealing tape. For example, the tape width could be 2 inches and the mask could be 1½ inches. This would provide that by centering the mask relative to the tape, marginal positions of the tape adjacent the mask retain unmasked pressure sensitive face areas as at 30 which run along both sides of the mask 26 and adhere to the carton end walls and thus hold the defined pull tabs closely juxtaposed with the carton end walls. This is a more advantageous pull tab disposition than that formed by the Bemis Company device discussed earlier as it avoids retention in the tape course of a freely movable tab end therein and is therefore less likely to be the source of accidental tape course peel-off. The manner in which the pull tab provided by the present invention lays up close against the carton end walls is illustrated in FIG. 7.

Figure 7:
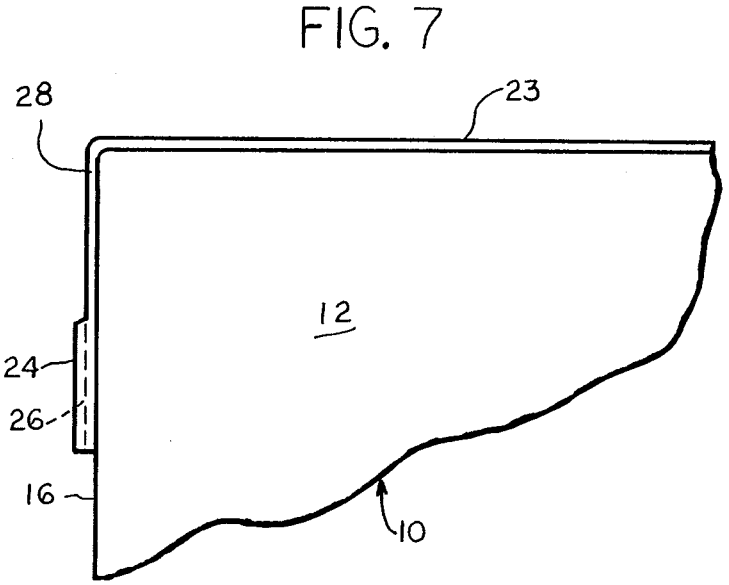
FIG. 7 is a fragmentary elevation view of a carton end wall section as viewed from the side illustrating how the pull tab formed with the present invention sets up close to the wall surface to inhibit accidental peel-off of the associated tape anchorage length.

The pull tab arrangement shown in FIGS. 1, 2 and 7 while lying up close to the carton end wall surface is nonetheless, readily accessible when an individual wishes to strip the tape course from the carton. There is a reasonably expansive unadhered segment of the end of the tape course which as noted above can be about 1½ inches wide and, e.g., about ¾ to one inch long. This provides ample room for a person to insert a finger tip, e.g., fore finger between the mask and adjacent wall surface and with the thumb at the outside grip the pull tab and then apply pulling force to peel or strip the tape away from the given carton end wall and along the remainder of the applied course length A further advantage of the invention is that pressure sensitive tape commonly is at least translucent so that by employment of contrasting colored masking material, the mask is readily visibly defined under the tape and is in of itself a telltale signal of the place the user will grasp to open the carton.

It will be understood that the mask 26 applied at a tape course terminal end is an element which has been applied to the carton sealing tape as an incident of the taping of a carton as will be explained in more detail by reference to FIGS. 3–6. The masking material will be applied to a sealing tape runout length, i.e., a length of tape drawing out during a given carton sealing operation which applied or "certain length" of masking material will constitute part of or be embodied in a pull tab in any of the next described manners.

As seen in FIG. 3, a length of masking material 32 will be adhered to the adhesive face of the tape runout length 34 relative to and proximate the locus L of such runout length. The locus L it will be understood is the line across the sealing tape at which it is severed from a continuous tape stock so that the severed length thereby becomes an applied one of the tape courses 21 by which a carton is sealed. In FIG. 3, the tape above or upstream of locus L is the lead end of the continuous tape stock and represents a tape part that will be applied on the front end of a carton in a next succeeding taping operation of the taping machine. The tape shown below or downstream of the locus L in FIG. 3 represents the trailing part of the runout length and that which is applied to the rear end of a carton in the given or present taping operation of the taping machine. The severing of the runout length of tape will produce the result shown in FIG. 4 from which the serrated cut edges of the tape are evident, a serrated cutting edge being a commonly used tape sectioning member in this art.

FIGS. 3 and 4 illustrate the application of the masking material 32 onto the pressure sensitive tape in a manner relative to locus L such that part of the masking material is upstream of the locus and part downstream. The parts can be of equal length or their length may be varied. When the sealing tape is severed, the adhered masking material is also sectioned and there will result two pull tabs 24-1 and 24-2. Pull tab 24-1 will serve as a pull tab at a second carton location, i.e., rear wall of a presently being taped carton. Pull tab 24-2 on the other hand is an element present on the continuous tape stock from which a runout length will be drawn in the next taping operation of he machine and so pull tab 24-2 will serve as such at the first location (front) wall on the next carton which travels through the machine for taping.

Figure 6:
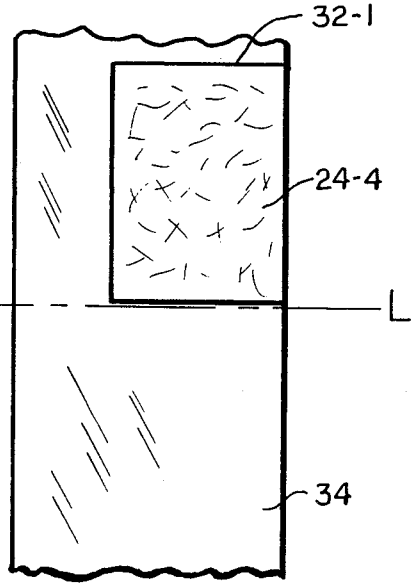
FIGS. 5 and 6 are views similar to FIG. 3 showing variations in the positioning of the masking material certain length relative to the tape runout length locus so that in the former instance a pull tab is applied only to the rear end of a carton being taped and in the latter instance, a pull tab is applied only to the front end of the next carton to be taped with tape drawn from the tape stock.

Application of the certain length 32 of masking material to the sealing tape in adhered joinder therewith and relative to locus L will be effected by the means and with control devices as will be described later but for the present it suffices to note that such application can be varied to provide variation in pull tab formation on the tape courses. Thus by applying the certain length 32-1 downstream of locus L, a pull tab 24-3 (FIG. 5) will be provided only at the rear wall of a presently taped carton. There will be no pull tab at the front end of such carton as it will be seen from FIG. 5 no masking material exists on the tape upstream of locus L. The tape above locus L will be applied to the front end of a next taped carton. FIG. 6 shows the reverse orientation, i.e., tape below locus L is unmasked and the carton having a pull tab 24-4 only on the front end effected with masking material applied to the tape in the prior carton taping operation.

With regard to application of a certain length of masking material to the pressure sensitive tape during a given carton taping operation it will be seen that the possibilities attendant therewith for provision of pull tabs can be (a) the certain length can become part of a pull tab formed in the carton during the given taping and part of a pull tab formed in the next carton taping (FIGS. 3 and 4), (b) only a pull tab on the carton taped in the given taping (FIG. 5), and (c) only a pull tab on the carton to be taped in the next taping operation.

Figure 13:
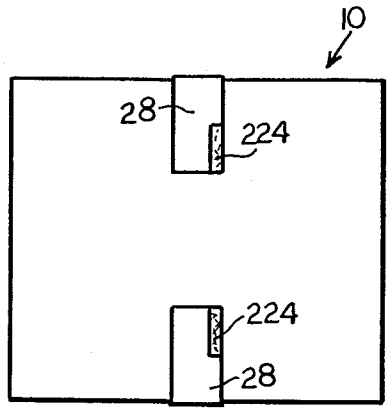
FIG. 13 shows how a pull tab of the FIG. 12 mask material embodiment is applied on an end wall of a carton.
Figure 12:
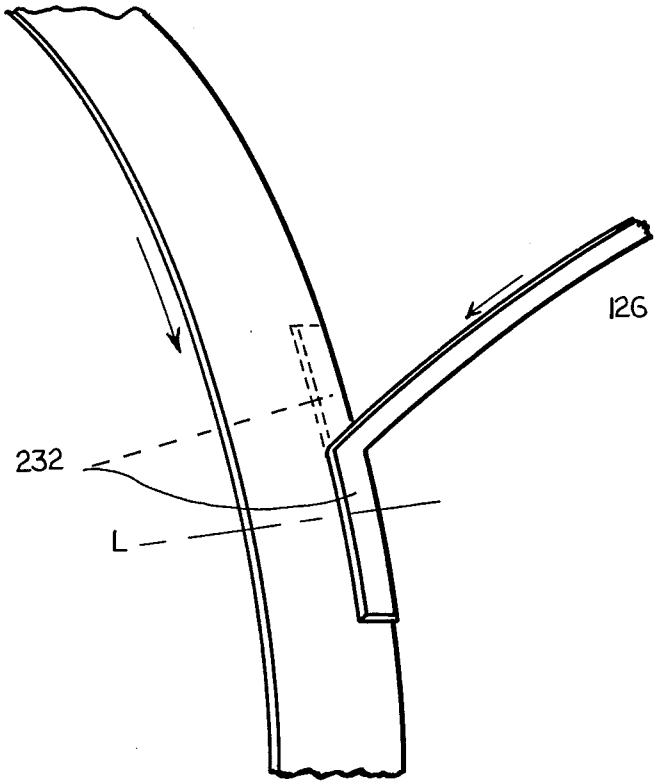
FIG. 12 is a perspective view illustrating the manner in which the masking material is adhered to the tape runout length, in the depicted embodiment, the masking material being of a width only a minor fraction of that of the tape width.

FIG. 12 shows how the masking material from a stock 126 is adhered to a tape runout length in an embodiment where the masking material width is only a minor fraction of the tape width. The certain length 232 thereof applied to the tape can be in the manner as illustrated in FIGS. 3 and 4, i.e. be disposed in equal lengths at both sides of locus L. The resultant pull tab arrangement 224 formed therewith is shown in FIG. 13 from which it will be noted the masking material, e.g., ¼ inch wide is only a minor width distance of the width of the tape, e.g., 2 inches. This means that a significant anchorage length of tape is retained adhered to the carton while at the same time, the narrow pull tab disposed adjacent to or alongside the adhered area provides ample grasping area for initiation of tape removal pulling action by the user.

FIG. 12 also shows how the masking material of E. G., ½ inch width can be applied to the tape, ¼ inch to the adhesive face and ¼ inch overlapping and laterally projecting beyond a tape margin as at 250 so the resultant pull tape as seen in FIG. 13 include unadhered masking material side gripping extensions 230. The extensions 230 also serve as readily seen box opening initiation location markers.

Description now will be given of the apparatus and the manner by which pull tabs 24 are formed and for which purpose reference should be made to FIGS. 8 and 9. The apparatus shown generally at 40 is embodied as part of a taping cartridge 42 of the type similar to those disclosed in and employed with the taping machines shown in commonly owned U.S. Pat. Nos. 4,028,865; 4,039,367 and 4,640,731. It will be understood that one of the two cartridge side plates 43 has been removed in FIG. 8 (and FIG. 10 as well) for purposes of clarity in depiction of the machine and apparatus elements involved in the formation of pull tabs. It also will be understood that while the apparatus of the invention is shown embodied in an upper cartridge unit, it could be mounted in a lower taping cartridge unit to apply pull tabs to carton bottom sealing courses or it could be mounted in a side taping cartridge that will tape courses on the side walls.

Figure 8:
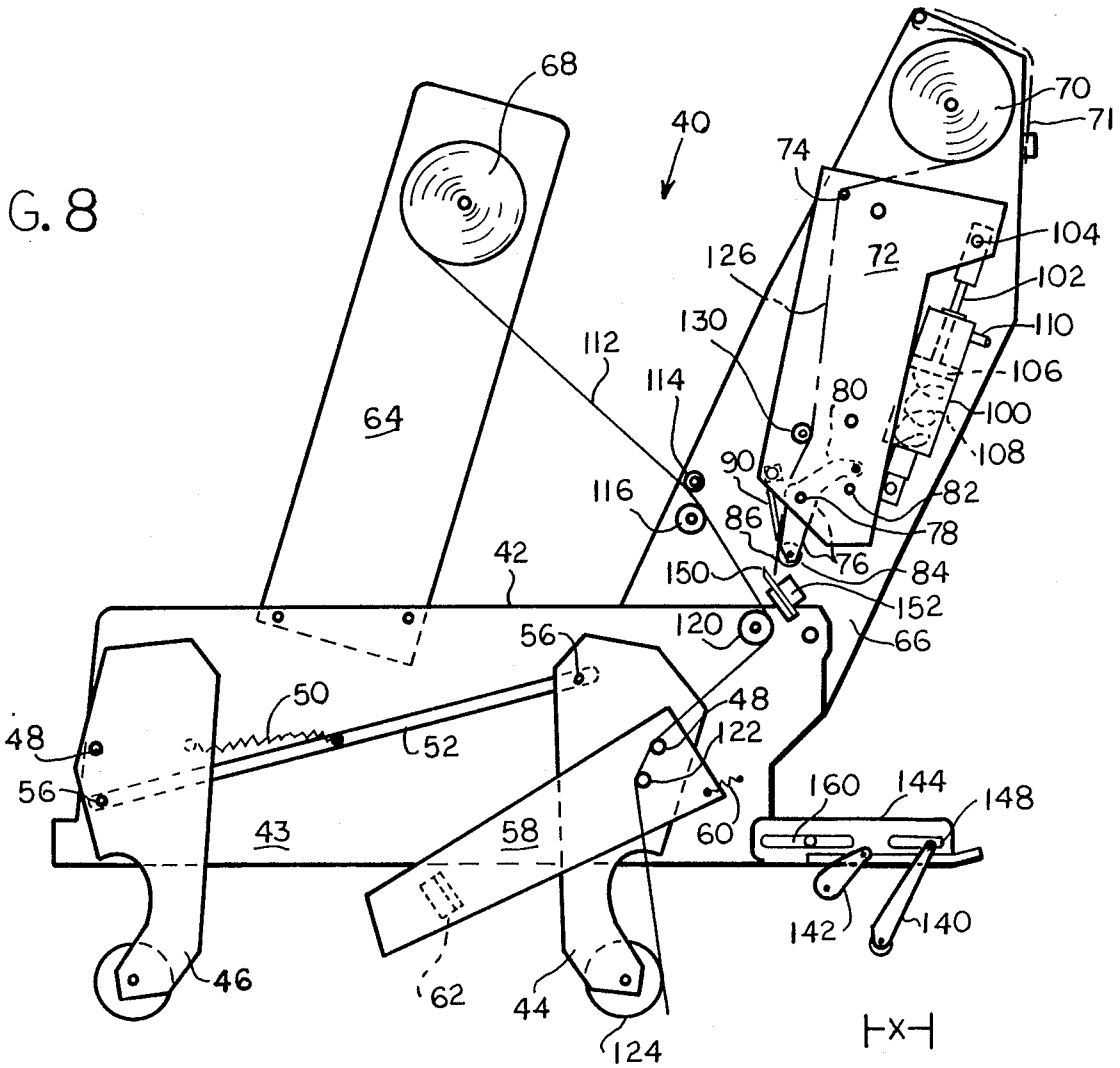
FIG. 8 is a side elevational view of the taping cartridge portion of a taping machine showing the components with which tape sealing of a carton is effected, the cartridge being equipped with apparatus as provided by the invention for forming non-adhering pull tabs in the carton tape courses, certain parts of the machine and cartridge not being shown.
Figure 9:
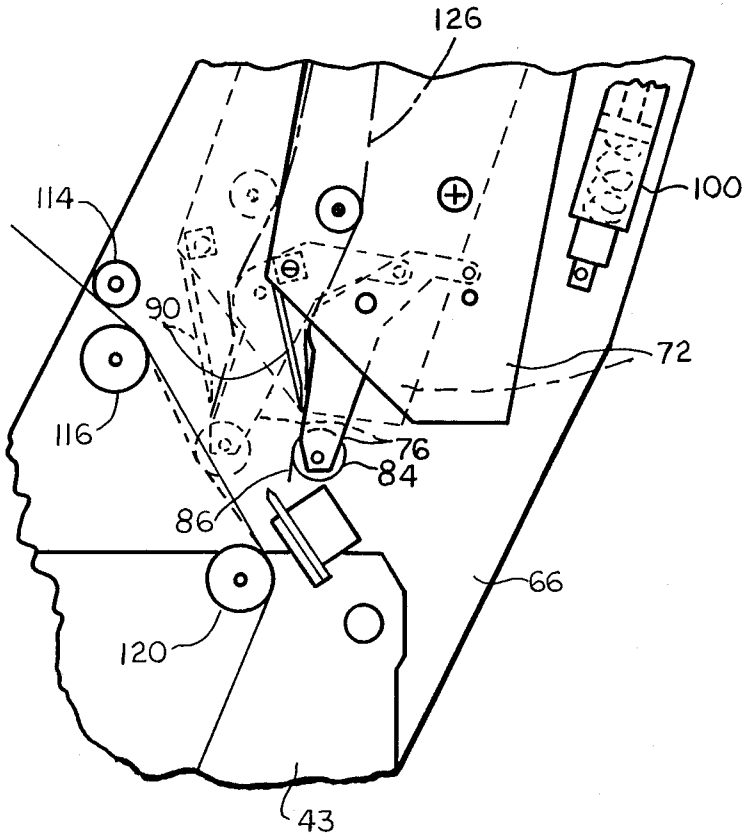
FIG. 9 is a fragmentary elevational view on enlarged scale of the masking material presser member showing its rotatable mounting on the arm member and how it presses the masking material against the adhesive face of the pressure sensitive tape.
Figure 10:
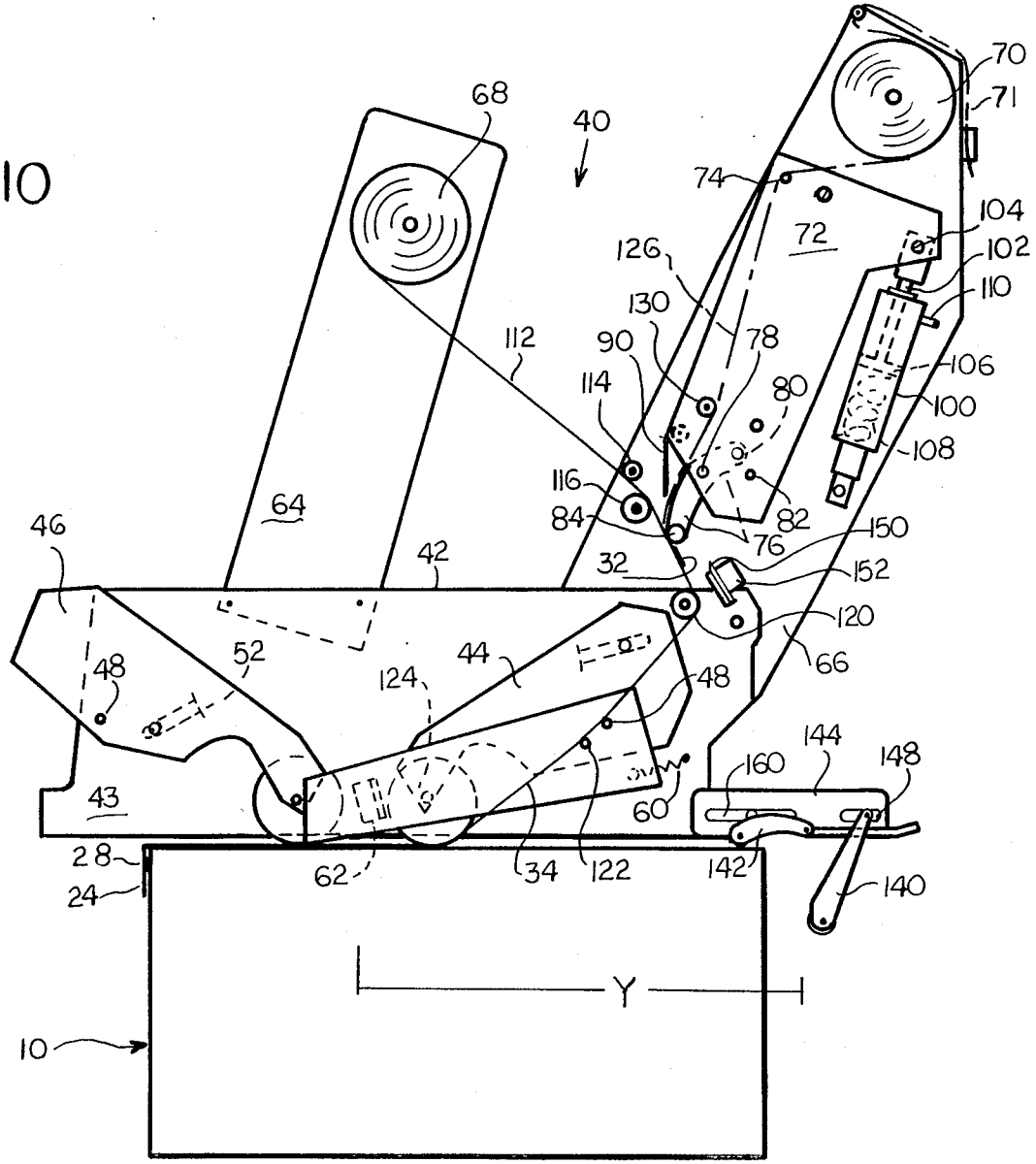
FIG. 10 is a view similar to FIG. 7 with certain parts omitted showing the taping arms and tape cutter in retracted position with a carton having just passed beyond the first of the two control switches to release said switch so that upon such actuation thereof, pressurized air flow is admitted to the air cylinder to stroke the arm member between first and second positions, the downstream located second switch still being in held position by the traveling carton.

Cartridge 42 includes paired tape applying arms 44, 46 movably mounted on their respective pivots 48 for movement between their normally extended position shown in FIG. 8 to the retracted position shown in FIG. 10. The arms are under the influence of tension spring 50 connected to coupling rod 52 and arm 46 which spring normally biases the arms to extended position. Coupling rod 52 is connected to arms 44, 46 on respective pivots 56 and thus the arms have tandem movement. A cutter member 58 is pivoted on the pivot 48 common with arm 44 and is under bias of tension spring 60 which tends to pivot it in a cutting direction. Carton travel through the machine will move the cutter member 58 which has a serrated cutting edge 62 to a retracted held-position as shown in FIG. 10.

Cartridge 42 mounts two brackets 64, 66. Bracket 64 serves to hold a stock 68 of pressure sensitive tape and bracket 66 holds at the top thereof, a stock 70 of masking material as well as the components of the apparatus of the invention. A weighted block or a biased shoe 71 can be engaged with the masking material roll of stock to prevent off-feed runaway. The mentioned components include an arm member 72 pivoted at one end thereof to the bracket 66 as at 74. The other end of arm member 72 carries a presser member 76 rotatably mounted to the arm member on pivot 78, the presser member being pivoted at mid-length thereof and having an upper end as at 80 located adjacent a stop 82 while the other or lower end of the presser member carries a roller 84, the roller serving to position an initial end 86 of the masking material stock feed remote from that stock. When in masking material applying mode, the presser member will pivot to limited degree against the force of bias (not shown). On release from that mode, counterpivoting is terminated by stop 82. The presser member presents on the left side thereof a course guidance and masking material feed retention structure quite similar to the ribbed guide plate 55 disclosed in U.S. Pat. No. 4,039,367; i.e., the masking material passes over the rounded surface of the presser member mid-length portion and courses under inturned guidance flanges extending down the presser member from the mid-length portion to the roller 84. Also carried on the arm member is a pivoted fork member 90 which holds an initial length part of the masking material snubbed against the presser member so that the initial end 86 thereof is in contact with roller 84. This pivoted fork member is essentially as the same construction of the fork 63 disclosed in the '367 patent.

An air cylinder unit 100 or like power motive unit such as an electrical solenoid unit is fixed at one end to bracket 66. The strokable rod 102 thereof is connected to arm member 72 as at pivot 104. In FIG. 8 the arm member is shown in its first or idle position, the second position to which it can be moved being shown in FIG. 10. The piston 106 connected to rod 102 has at its underface a compression spring 108 and air under pressure is admitted at the other face of the piston through air line 110.

The pressure sensitive tape has a feed course 112 which following off-feed from stock 68 passes between guide rollers 114, 116, courses over and around guide roller 120 on the cartridge and then leads down into arm member 44. In the arm member the tape feeds around common pivot 48, on guide roller 122 and down below to termination at the right side of wipe-down roller 124 carried on the tip end of taping arm 44. The pressure sensitive face of the tape is to the right side thereof in FIG. 8. The off-feed path 126 of the masking material from stock 70 thereof passes down through arm member 72 coursing around pivot 74, against course guidance member 130 and then onto the presser member rounded mid-body part. This off-feed path is shown with long and short dashed lines.

When a carton is fed into the tape sealing machine, the front end thereof will engage the pressure sensitive face of the lead end of the tape held by wipe-down roller 124 applying tape to the first location on the carton. In preferred form, a mask 26 will be present on that front end from a prior taping operation as shown, for example, in FIGS. 3, 4 and 6. If the lead end is as follows from the FIG. 5 disposition of masking material in the prior taping operation, there will be no mask, on the tape. As the carton continues to advance, the taping arms 44, 46 start to retract and eventually reach the position of FIG. 10. Such carton movement also will cause draw out of a runout length of tape from stock 68 ("stock" in this sense being inclusive of the tape present in feed course 112) which constitutes the predetermined length of tape which will be applied to the carton. That length is determined by passage of the carton beyond the held-position of cutter member 58 which will then extend and sever the runout length of tape from the remainder of the stock, with tape applying arm 46 thereafter running down the rear wall of the carton to apply the tape thereto.

Application of pull tabs to the taped course 21 on the carton now will be described and in respect of application of pull tabs on the front and rear walls of the carton as shown in FIGS. 3 and 4 as the taping is taking place. The tape which is held by the wipe-down roller 124 will have a mask thereon, i.e., a portion of the certain length which had been applied to the runout length of the prior taping operation. Thus a pull tab is formed at the first location as the application of tape course 21 commences. The carton now travels through the machine and events as described above occur. The travel of the carton during taping is involved in the application of masking material to the tape runout length during the taping operation and particularly its presence at each of two succeeding predetermined locations of the carton travel, more particularly those locations where the carton rear wall has passby of two carton actuated switches. FIGS. 8 and 10 show this arrangement. Two switches 140, 142 are mounted on a housing 144 carried on cartridge 42. Normally the switches extend downwardly as shown in FIG. 8. However, carton engagement therewith retracts these switches, switch 142 being shown in retracted or held-position in FIG. 10, switch 140 having been released as the carton rear wall has moved downstream therefrom. These switches it will be understood are actuators for cores of the respective air valves LV1 and LV2 shown in FIG. 11 and more details of the air operation in the apparatus will be discussed later with reference to FIG. 11.

When the carton is moving under the retracted arms 44, 46 and cutter member 58 during the early part of the taping operation, it also will hold switches 140, 142 retracted and arm member 72 is in idle first position. As soon as the carton rear wall makes pass by of switch 140 it is released or "actuated". This causes air to be supplied to air cylinder unit 100 so that its rod 102 is pulled down and arm member pivoted from the FIG. 8 to FIG. 10 position. During that movement the presser member 76 is moved leftwardly and the masking material initial end 86 is urged or moved into adhering contact with the adhesive face of the tape runout length. Since the masking material is thus adhered to the tape and the runout length is moving downwardly, the masking material will be off-fed from stock 70 and in adhered contact with tee tape. FIG. 9 shows this operation to larger scale. The carton rear wall then has passby of switch 142 and it is released from held position or "actuated". The result of this actuation is to release or dump the air pressure in cylinder unit 100 and in consequence, compression spring 108 strokes rod upwardly and arm member 72 is returned from second to first positions. In this return movement, the masking material retained in presser member 72 is pulled across the cutting edge 150 of cutter 152 fixed to the cartridge 42. This severs a certain length of masking material from its stock. That certain length of masking material is carried forward adhered to the sealing tape and the upstream part of the masking material is positioned at its initial end on roller 84 ready for the next taping operation. The certain length of masking material follows on the tape runout length through taping arm 44 and when cutter member 58 is released from its held-position by carton rear end passby, it will cut the tape at its locus L (FIG. 3). This results in the FIG. 10 apparatus with a concurrent cutting of the adhered masking material into two portions one on either side of the locus. The downstream portion it is noted provides a pull tab at the rear end of the carton. The upstream portion remains on the tape fed for the next taping operation.

Figure 5:
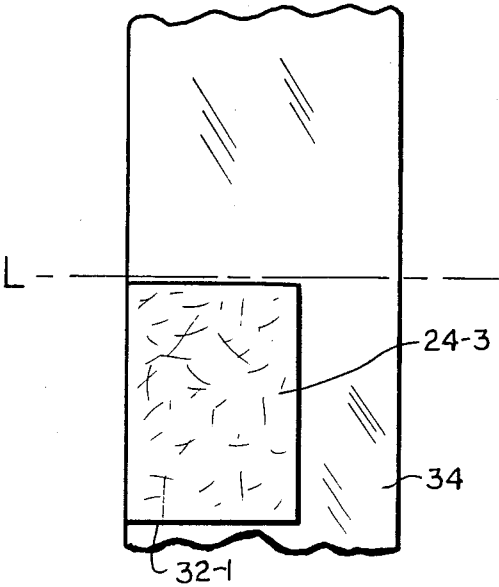

The certain length of masking material laid onto the sealing tape during a given taping operation is controlled to be shorter or longer by longitudinally adjusting the longitudinal positioning of switches 140, 142 relative to each other. Thus the housing 144 has a slot 148 by means of which this can be accomplished. The spacing X between switches 140, 142 will of course once set for a given length, be fixed by locking means for the switches (not shown). Positioning of the switches as a unit also is employed to set the point at which the certain length of masking material will be sectioned after it is adhered to the tape runout length. In the FIG. 10 apparatus, the longitudinal distance Y between the pivot point of switch 142 and the cutting edge 62 of cutter member 58 will determine where the locus L cutting of the tape will occur. Thus if housing 144 is moved to an extreme leftward position in slot 160, the locus L cut will leave the masking material all downstream of the locus as shown in FIG. 5. On the other hand movement to an extreme right position will leave all the masking material upstream of the locus as shown in FIG. 6.

Figure 11:
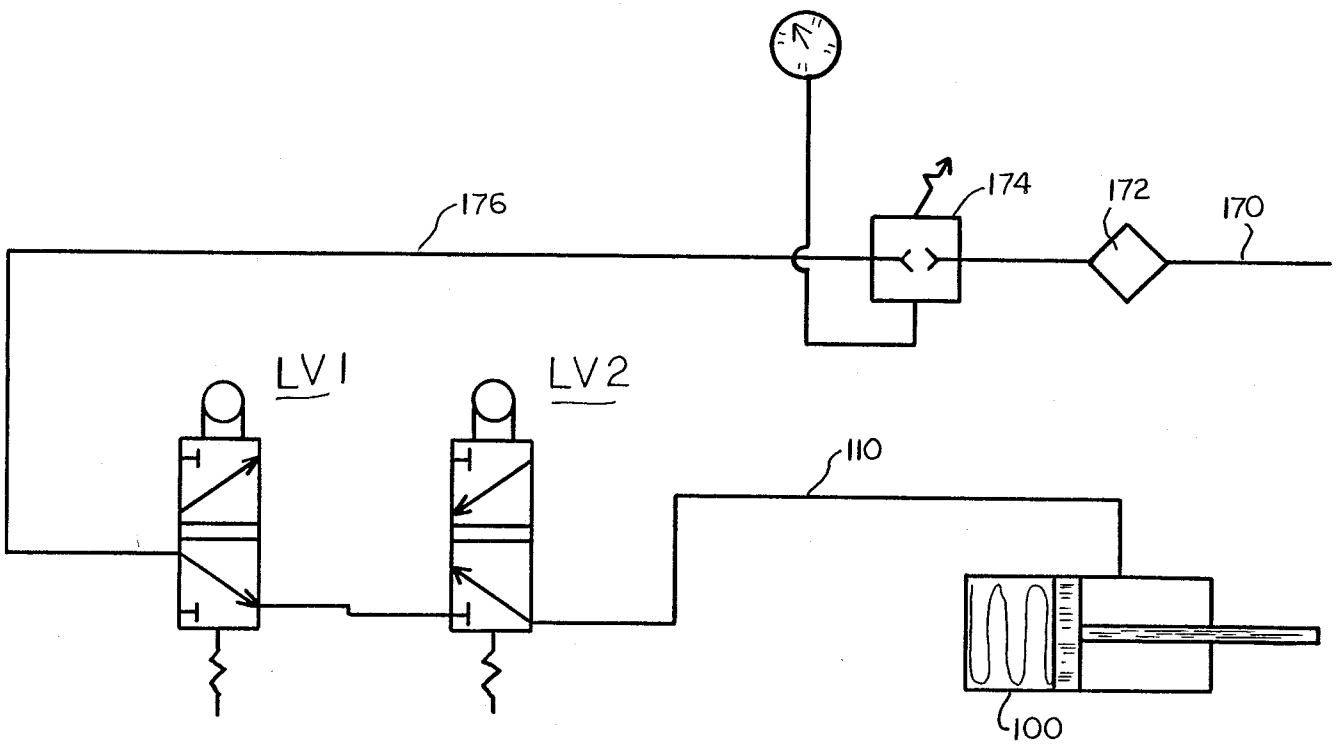
FIG. 11 is an air control circuit diagram depicting the control arrangement for moving the masking material into and out of contact with the sealing tape.

FIG. 11 shows the air control system. Pressurized air from source 170 passes through filter 172, pressure reducer 174 and supply line 176 to valve LV1. Valve LV1 is in series with valve LV2. Thus the cores of both must be open to pass air through line 110 to air cylinder 100. Valve LV1 is a normally open core and valve LV2 has a normally closed core. Thus when the carton retracts switches 140, 142 to held-position of each, the core of valve LV2 will be opened but that of LV1 will be closed. Thus air from line 176 cannot at any time pass into air cylinder 100. However as soon as switch 140 is released by carton passby the core of valve LV1 returns to open position and air can pass through to the cylinder to stroke the arm member 72 to second position since valve LV2 is still held open by the carton engaging switch 142. As soon as the carton makes passby of switch 142, valve LV2 will shift to closed core condition and the air supply to the air cylinder is terminated.

While there is above disclosed only certain embodiments of the apparatus and method of the invention variations and modifications thereto can be made by those skilled in the art without departing from the scope of the inventive concept disclosed.

What is claimed is:

1. In tape sealing of a carton with a predetermined length of pressure sensitive tape sealing applied to the carton between first and second locations on the carton, the tape having an adhesive face, the carton being advanced in a continuously forwardly travelling direction to initiate the application and pressing of the tape adhesive face against the carton at said first location, with the forwardly travelling carton drawing a runout length of said tape from a continuous stock thereof so that such runout length can be pressed against the carton and be cut-off from the continuous stock at a runout length locus that will correspond to a termination of the predetermined length at said location, a method for forming a nonadhering pull tab in said predetermined length of tape at at least one of said two locations, said method comprising engaging an edge portion of masking material from a feedable continuous stock thereof against the tape runout length adhesive face as said runout length is being drawn from said continuous stock at a point thereon relative to and proximate the tape runout locus to adhere said masking material to the runout length and therewith effect concurrent masking material off-feed from its stock, and cutting the off-feeding masking material from its stock after a certain length thereof has off-fed from such stock so that when said tape runout length is severed from its stock at said locus thereof masking material of said certain length will be adhered to said tape along at least one of a length part running downstream of said locus o serve as a mask blocking adhesion to the carton of a segment of the tape applied to the second location on the carton being taped, and a length part running upstream of said locus to serve as a mask blocking adhesion to the carton of a segment of the tape to be applied to the first location on a carton to be next taped with a tape runout length from said tape stock, each such blocked tape segment together with the blocking mask material defining a readily digitally gripped and manipulated pull tab with which the length of tape applied to the carton can be removed with pulling force applied to the pull tab, engagement of the masking material with the runout length adhesive face being initiated by detecting the presence of the forwardly travelling carton at a predetermined travel location thereof, the cutting of the masking material being initiated by detecting the presence of the forwardly travelling carton at a second predetermined travel location thereof downstream of the first predetermined travel location.

2. The method of claim 1 in which the masking material is engaged with the tape runout length adhesive face at a point thereon relative to the runout length locus such that the certain length of masking material is disposed along its entire length downstream of the runout length locus and a trailing edge of said masking material certain length is substantially coincident with said locus so that said certain length can serve only as a mask blocking adhesion to the carton of tape applied to the second location on the carton being taped.

3. The method of claim 1 in which the masking material is engaged with the tape runout length adhesive face at a point thereon relative to the runout length locus such that the certain length of masking material is disposed along its entire length upstream of the runout length locus and a fore edge of said masking material certain length is substantially coincident with said locus so that said certain length can serve only as a mask blocking adhesion to a carton of tape to be applied to the first location on a carton to be next taped with a tape runout length from the said tape stock.

4. The method of claim 1 in which the masking material is engaged with the tape runout length adhesive face at a point thereon relative to the runout length locus such that the certain length of masking material is disposed along a portion of its length downstream of the runout length locus and along its remainder length upstream of said locus, the respective masking material length portions serving as a mask blocking adhesion of tape applied to the second location on the carton being taped and as a mask blocking adhesion of tape to be applied to the first location on a carton to be next taped with a tape runout length from the said tape stock.

5. The method of claim 4 in which the respective masking material length portions are of substantially equal lengths.

6. The method of claim 1 in which the masking material has a width narrower than the adhesive face of th pressure sensitive tape whereby there remains on the tap applied at first and second carton locations at least one unblocked area of the adhesive face adjacent a blocked segment thereof which can adhere to the carton and thereby hold the defined pull tab closely juxtaposed to the carton.

7. The method of claim 4 in which the masking material has a width narrower than the adhesive face of the pressure sensitive tape whereby there remains on the tape applied at first and second carton locations at least one unblocked area of the adhesive face adjacent a blocked segment thereof which can adhere to the carton and thereby hold the defined pull tab closely juxtaposed to the carton.

8. The method of claim 7 in which the masking material is adhered symmetrically of the tape adhesive face whereby unblocked marginal areas of the said adhesive face are present at opposite sides of a blocked segment.

9. The method of claim 7 in which said masking material is a paper.

10. The method of claim 7 in which said masking material is a metallic foil.

11. The method of claim 7 in which said masking material is a synthetic material film.

12. The method of claim 7 in which said masking material is a pressure sensitive tape having an adhesive face, the adhesive face of the masking material being oriented to off feed from the stock thereof in confrontation to the adhesive face of the sealing tape for engagement therewith.

13. The method of claim 4 in which the carton has front and rear ends, top and bottom walls and side walls, the first location at which tape is applied being on the carton front end and the second location on the rear end, the length of tape extending between said two locations being sealed to one of said top and bottom walls or optionally to one of said side walls.

14. The method of claim 10 in which the masking material has a width which is only a minor fraction of the width of the tape and is adhered at a marginal side area of the tape whereby the tape area adjacent said masking material adheres to a carton surface to hold the pull tab closely juxtaposed to the carton surface.

15. The method of claim 10 in which the masking material is adhered to the tape adhesive face with a portion thereof extending laterally beyond a margin of the tape to provide a pull tab which includes an unadhered masking material side gripping extension adjacent the tape margin.

16. In a machine for tape sealing a carton moving in a forwardly travelling course with a length of pressure sensitive tape in a taped course having a length extending between first and second locations on the carton and which includes movably mounted tape applying means normally biased into a projecting position in the carton travel course and operable when the carton engages therewith to apply an adhesive face side of the tape to the carton at said first location thereon with the forwardly travelling carton then moving the said means in a retracting direction while concurrently drawing a runout length of tape in a runout path from a continuous stock thereof which said means applies it to the carton, and movably mounted cutter means including bias means tending to move said cutter means in a tape cutting direction, the carton during its forward travel engaging said cutter means to move it in a direction opposite to said cutting direction to a held-position whereby the bias acting thereon moves it in a cutting direction to sever the tape runout length from the continuous stock at a tape runout length locus that will correspond to a termination of the taped course at said second location, apparatus for forming non-adhering pull tabs in the taped course length at said first carton location and/or said carton second location, said apparatus comprising a feedable stock of a masking material, said stock having an initial end thereof, means operable to move the masking material initial end into adhering contact with the tape runout length adhesive face as the latter is being drawn out from its stock and at a point thereon relative to and proximate the tape runout length locus thereby to effect a concurrent off-feed of the masking material from its stock, said last-mentioned means comprising a presser member disposed remote from the masking material and positioning the initial end of said masking material in proximity to the pressure sensitive face of the tape runout length travel path, said presser member being carried on a movable arm member pivoted at an end thereof, the presser member being carried at the other end of said arm member, the arm member having a first idle position wherein the presser member holds the masking initial end spaced from the tape runout length and a second operating position wherein the presser member presses the initial end of the masking material against the tape adhesive face, a power operated unit connected with said movable arm member and operable on application of power thereto to move the arm member from first to second positions thereof, said unit embodying means operable upon termination of power thereto to move the arc member from second to first positions, means operable to control application of power and termination thereto said power unit, said control means being operated by detecting the presence of the forwardly travelling carton at predetermined travel locations thereof, the control means including a carton movement actuated switch disposed at a first predetermined carton travel location, actuation of said switch initiating application of power to said power unit, the control means further including a carton actuated second switch disposed at a second predetermined carton travel location downstream of the first switch, actuation of said second switch terminating application of power to said power unit, and means for cutting the off-feeding masking material from its stock after a certain length thereof has off-fed from such stock so that when the tape runout length is severed from its at the locus thereof at least a portion of the masking material certain length will be adhered to said tape along at least one of a length part running downstream of said locus to serve as a mask blocking adhesion to the carton of a segment of the tape applied to the second location on the carton being taped, and a length part running upstream of said locus to serve as a mask blocking adhesion to the carton of a segment of the tape to be applied to the first location on a carton to be next taped with a tape runout length from the said tape stock, each such blocked tape segment together with the blocking mask material defining a readily digitally manipulated pull tab with which the length of tape applied to the carton can be removed with pulling force applied to the pull tab.

17. The tape sealing machine of claim 16 in which the masking material cutting means comprises a cutter disposed adjacent the course of movement of the presser member as the movable arm member moves between its two positions, the masking material off-feeding from its stock being pulled across the cutter as said arm member moves from second to first positions thereof to cut said masking material leaving the masking material downstream of the cut adhered to the pressure sensitive face of the tape as the masking certain length, the masking material upstream of the cut remaining as a masking material initial end for use in the next carton tape sealing operation.

18. The tape sealing machine of claim 16 in which said presser member comprises a lever mounted rotatably on the other end of said arm member, the lever having a masking material engaging tip end.

19. The tape sealing machine of claim 18 in which the arm moving unit comprises a power operated rod strokable in a first direction to cause pivoting of said arm between its first and second positions, there being bias means connected with said rod tending to urge it in an opposite direction and said arm member to its first position.

20. The tape sealing machine of claim 19 in which the rod is the piston rod of a fluid cylinder unit, fluid pressure presence at one face of said piston causing stroking of said rod in said first direction.

21. The tape sealing machine of claim 20 in which the bias means is carried in said cylinder unit at an opposite face of the piston and in the absence of fluid pressure at said one piston face being operable to move said arm member from second to first positions and maintain it in said first position.

22. The tape sealing machine of claim 16 in which said first and second switches are moved to a held position by carton engagement therewith, passage of the carton successively beyond said two switches providing release actuation of these switches to effect respective application and termination of power to the power unit.

23. The tape sealing machine of claim 22 in which said two switches can be selectively, longitudinally adjustably spaced one with respect to the other thereby to correspondingly adjust the certain length of the masking material applied to the pressure sensitive tape.

24. The tape sealing machine of claim 22 in which said two switches can be unitarily selectively, longitudinally adjusted relative to the position of the tape cutter means in the held position thereof to correspondingly adjust the lengths of the masking material length parts which run upstream and downstream of the locus at which the tape runout length is severed from its stock.

25. The tape sealing machine of claim 16 comprising means defining a mounting bracket, the feedable stock of masking material being carried on said mounting bracket, said movable arm member being pivoted on said mounting bracket adjacent said feedable stock, said movable arm member including masking material off-feed path defining and guidance means, and a fork member in contact with the masking material off-feed length immediately upstream of the initial end thereof to hold said initial end engaged against said presser member.

* * * * *